United States Patent [19]

Tiedemann et al.

[11] Patent Number: 4,919,284

[45] Date of Patent: Apr. 24, 1990

[54] PLASTIC CONTAINER WITH RING STABILIZED BASE

[75] Inventors: William H. Tiedemann, Cedarburg; Dennis L. Marshall, Wauwatosa, both of Wis.

[73] Assignee: Hoover Universal, Inc., Ann Arbor, Mich.

[21] Appl. No.: 335,998

[22] Filed: Apr. 10, 1989

[51] Int. Cl.[5] ..... B65D 25/24

[52] U.S. Cl. ..... 215/12.1; 215/1 C; 215/100 R; 220/69

[58] Field of Search ..... 215/1 C, 100 R, 12.1; 220/69, 70; 248/346.1; D9/369

[56] References Cited

U.S. PATENT DOCUMENTS

| | | | |
|---|---|---|---|
| D. 283,308 | 4/1986 | Oakley et al. | D9/369 |
| 2,837,245 | 6/1958 | Grebowiec | 215/1 C X |
| 3,722,725 | 3/1973 | Khetani et al. | 220/69 X |
| 3,838,789 | 10/1974 | Cuacho | 220/69 |
| 4,127,207 | 11/1978 | Hubert et al. | 220/69 X |
| 4,334,627 | 6/1982 | Krishnakumar et al. | 220/70 X |
| 4,463,860 | 8/1984 | Yoshino et al. | 220/69 X |
| 4,573,597 | 3/1986 | Adams et al. | 220/69 X |

FOREIGN PATENT DOCUMENTS

| | | | |
|---|---|---|---|
| 2159805 | 6/1972 | Fed. Rep. of Germany | 215/100 R |
| 2510457 | 10/1975 | Fed. Rep. of Germany | 215/1 C |
| 497177 | 9/1955 | Italy | 215/12.1 |
| 697360 | 11/1965 | Italy | 215/12.1 |

*Primary Examiner*—Sue A. Weaver

*Attorney, Agent, or Firm*—Harness, Dickey & Pierce

[57] ABSTRACT

A plastic container is provided which includes a stabilizing ring attached to the base structure of a blow molded bottle for improving the vertical stability to the container when supported upon a horizontal surface. The container includes a plastic bottle having a tubular sidewall and a base structure closing the bottle at an end of the sidewall. The base structure includes an outer wall having a radially inner lower edge portion, an inner wall within the outer wall which has an axial recessed portion extending upward into the container. The lower edge portions of the inner and outer walls are merged together. The stabilizing ring is attached to the base structure and extends radially outwardly and downwardly forming an annular supporting surface at the lower edge of the ring upon which the container is supported.

13 Claims, 2 Drawing Sheets

PLASTIC CONTAINER WITH RING STABILIZED BASE

BACKGROUND AND SUMMARY OF THE INVENTION

This invention relates generally to plastic beverage containers and more particularly to an improved container comprising a blow molded bottle with a stabilizing ring attached to the base of the bottle extending radially outwardly and downwardly to increase the vertical stability of the container when supported upright on a horizontal surface. By vertical stability is meant the ability of the container to resist tipping over from its upright position. Resistance to tipping is important for both empty and full containers being handled by automatic equipment or by individual people.

A major difficulty with the use of plastic bottles for carbonated beverages is in providing sufficient strength to the base of the bottle to prevent undesirable deformation. Due to internal carbonation pressures in the bottle which can exceed 75 psi, plastic bottles can deform in the base structure resulting in a bottle which will not stand upright on a flat surface. In addition, when the base deforms, the volume of the bottle typically increases, thereby lowering the fill line of the bottle such that potential consumers may believe that the bottle was not properly filled or sealed.

One solution to the problem of base deformation is to provide a bottle having a hemispherical base extending downward from the lower end of the sidewall. A second piece, commonly known as a base cup, is attached to the hemispherical base to provide stability. The base cup includes a generally flat bottom and an upstanding cylindrical wall extending upwardly from the periphery of the bottom and engages the side of the bottle. This type of container is commonly referred to as a composite container and is widely used for carbonated beverage containers of sixteen ounces or more.

The disadvantages of a composite container include increased material cost and weight. Base cups are often made of polyethylene which has dramatically increased in cost. The base cup contributes approximately one-third of the container weight while contributing almost one-half of the material cost.

To overcome the disadvantages of a composite container, one-piece bottles have been developed with reinforced base structures. The plastic material in the base is greater than the bottle base of a composite container but the total one-piece container weighs less than the composite container including the base cup.

A one piece plastic bottle is disclosed in U.S. Pat. No. 3,598,270 to Adomaitis et al which is typically used for containers having a capacity of two liters. The base of this bottle has a hemispherical bottom wall with a plurality of hollow legs extending downwardly from the bottom wall. However, it can be difficult to consistently mold this bottle with the plastic being properly molded in the bottom of the hollow legs to form a horizontal supporting surface for the bottle.

For small containers with a capacity of sixteen ounces, another base configuration for a one-piece bottle is disclosed in U.S. Pat. No. 4,334,627. The base of this bottle has a central recessed portion forming a dome which extends upwardly into the bottle similar to a champagne bottle base. A number of radially extending solid ribs are molded onto the inner surface of the base to provide added strength to prevent deformation of the base. It is difficult, however, to make this bottle having a capacity larger than sixteen ounces with sufficient strength in the base. As the capacity of the bottle is increased, the diameter of the central recess also increases, increasing the reinforcement needed in the base.

Accordingly, it is an object of the present invention to provide a container that is economically and consistently blow molded, that has a base structure resistant to deformation caused by internal pressures and that has vertical stability equal to or better than the prior art containers.

It has been discovered that a plastic container having a central recessed dome in the base can be made with sufficient strength to prevent undesirable deformation, without the internal ribs shown in U.S. Pat. No. 4,334,627, if the diameter of the dome is sufficiently small. The outer periphery of the dome portion of the container forms an annular heel which functions as a support surface for the container. By reducing the size of the dome to increase its strength, the diameter of the heel is also reduced. This in turn reduces the vertical stability of the container To increase the vertical stability of the container, a separate stabilizing ring is attached to the base structure which extends radially outwardly and downwardly to form a container support of increased diameter.

Further objects, features and advantages of the invention will become apparent from a consideration of the following description and the appended claims when taken in connection with the accompanying drawings.

DETAILED DESCRIPTION OF THE PREFERRED EMBODIMENT

Figure 1:
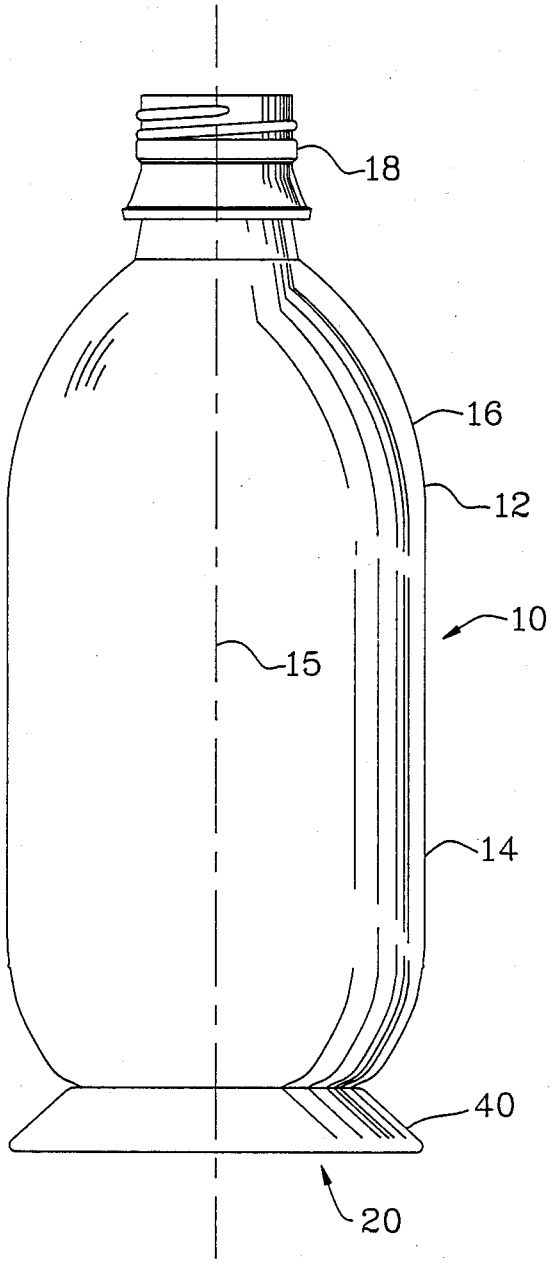
FIG. 1 is a side elevational view of a container according to this invention having a stabilizing ring attached to the base structure of the plastic container.

The container of this invention, having a stabilizing ring attached to the base, is shown in FIG. 1 and is designated generally at 10. The container 10 includes a plastic body 12 which is preferably blow molded from a polyethylene terephthalate (PET) preform. The plastic body 12 includes a tubular sidewall 14 having an upright longitudinal axis 15. A tapered shoulder portion 16 extends upwardly from the upper end of the sidewall 14 and tapers into a neck 18 which is threaded for engagement with a suitable closure (not shown).

A base structure 20 extends downwardly from the lower end of the sidewall 14 and closes the lower end of bottle 12. A stabilizing ring 40 is attached to the base structure 20 and extends radially outwardly and downwardly forming a lower annular support upon which the container is supported in an upright manner.

Figure 2:
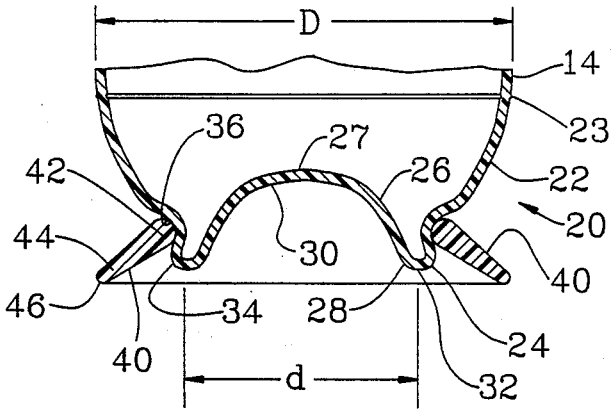
FIG. 2 is a vertical sectional view of a lower portion of the container of FIG. 1, showing the base structure and stabilizing ring of the container.

Referring now to FIG. 2, the base structure 20 is shown in section. The base structure 20 includes an outer wall 22 which extends downwardly and radially inwardly from the lower end 23 of the sidewall 14. Outer wall 22 includes a radially inner lower edge portion 24 at the bottom of the outer wall 22. An inner wall or bottom wall 26 is disposed within the outer wall and forms a central dome 27 extending axially upwardly into the container having a concave exterior surface 30. The inner wall 26 has a radially outer lower edge portion 28 at the periphery of the dome 27 which is merged with the radially inner lower edge portion 24 of the outer wall 22 forming an annular heel 32 at the lowermost point of the plastic body 12. The annular heel has a diameter "d".

To increase the vertical stability of the container an annular stabilizing ring 40 is attached to the base structure. The stabilizing ring 40 includes a radially inner engaging portion 42 which engages the base structure 20 for attaching the ring to the base structure. The ring 40 includes a support portion 44 which extends radially outwardly and downwardly from the engaging portion 42 to form an annular support 46 upon which the container is supported in an upright manner. The support 46 is radially outward and downwardly of the annular heel 32 and thus improves the vertical stability of the container 10. The stabilizing ring 40 shown in FIG. 2 has a generally wedge shape cross section which tapers radially outwardly from the engaging portion 42 to the outer support portion 44.

The outer wall 22 includes an annular tapered portion 34 adjacent the radially inner lower edge portion 24. Tapered portion 34 tapers inwardly and upwardly to form an annular recess 36 in the outer wall 22. The stabilizing ring 40 is snap fit onto the base structure 20 with the engaging portion 42 of the ring seated into the recess 36.

The inner diameter of the stabilizing ring 40, at the engaging portion 42, is approximately the same as the diameter of the outer wall at recess 36. This diameter is less than the diameter of the radially inner lower edge 24 of the outer wall 22 due to the tapered portion 34. This enables the stabilizing ring 40 to be snap fit over the lower edge portion 24 of the outer wall, causing the outer wall to flex inwardly as the ring 40 is placed on the base structure. The ring 40 is then held in place by frictional engagement with the outer wall.

The diameter of the support 46 is shown in FIG. 2 as being approximately the same as the diameter "D" of the tubular sidewall 14 of the bottle 12. The diameter of the support 46 is considerably larger than the diameter "d" of the annular heel 32 such that the addition of the stabilizing ring 40 greatly increases the vertical stability of the container.

The stabilizing ring 40 is injection molded of PET, polyethylene or other plastic resins. Preferably, the weight of the stabilizing ring is less than the weight of the base cup for a comparable size container. The stabilizing ring 40 can be molded of the same plastic resin as used to mold the plastic body such that separation of the plastic body and ring prior to recycling of the materials in the container is not necessary.

Figure 3:
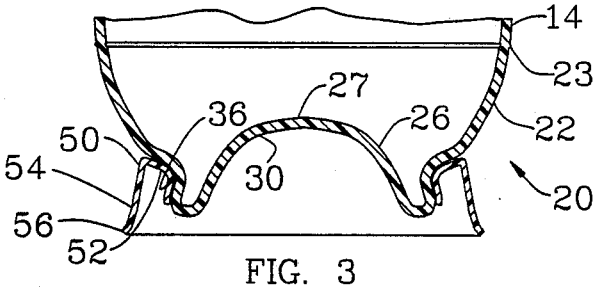
FIG. 3 is a sectional view like FIG. 2 showing the base structure with a modified form of the stabilizing ring.

FIG. 3 shows an alternative embodiment of the container utilizing a stabilizing ring 50 having a relatively thin wall and an arch shape cross section. The engaging portion of the stabilizing ring 50 includes an engaging wall 52 which forms the radially inner portion of the arch. Engaging wall 52 engages the outer wall 22 of the base structure in the recess 36 and above the recess 36. The support portion of the stabilizing ring 50 includes a supporting wall 54 which comprises the radially outer portion of the arch shape cross section and extends radially outwardly and downwardly from the top of the engaging wall 52. The lower end of the support wall 54 terminates in an annular support 56 upon which the container 10 is supported in an upright position. The stabilizing ring 50 can also be injection molded from PET, polyethylene or another plastic resin or, alternatively, the ring 50 can be stamped from sheet metal.

The stabilizing ring 50, like the ring 40 described above, has an inner diameter approximately equal to the diameter of the recess 36 and less than the diameter of the outer wall lower edge portion 24. This enables the ring 50 to snap fit into the recess and be frictionally retained to the base structure.

The container 10, having a central dome in the base, is resistant to deformation caused by internal pressure and to damage from impacts to the base. The center of the dome is formed from the gate area of the injection molded preform, an area which is preferably protected from impact. The dome structure thus protects this portion of the base from impact. The stabilizing ring provides increased vertical stability to the container and also provides additional impact protection by flexing upon impact to absorb a portion of the impact energy.

Figure 3A:
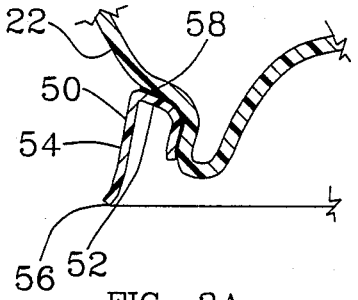
FIG. 3A is an enlarged view of a portion of the base structure shown in FIG. 3 with an adhesive layer bonding the stabilizing ring to the bottle.

When the container 10 is filled with a carbonated beverage, the internal pressure acts upon the outer wall below the recess 36 forcing the lower edge portion 24 of the outer wall 22 radially outwardly to help retain the stabilizing ring in the recess 36. The stabilizing ring can also be adhesively bonded to the base structure with a suitable adhesive. The stabilizing ring 50, shown in FIGS. 3 and 3A, is particularly suited to use with an adhesive with an adhesive layer 58 being placed between the outer wall 22 and the engaging wall 52 of the stabilizing ring 50 as shown in FIG. 3A.

It is to be understood that the stabilizing ring can be of any desired shape which achieves the objectives of the invention. The rings illustrated in FIGS. 2 and 3 are only examples of two possible shapes for use in describing the invention.

The plastic container of this invention includes a champagne bottle type base with an axially recessed dome of a small diameter extending upwardly into the container. Due to its small diameter, the recessed dome is resistant to eversion and deformation caused by internal pressures in the container. To enhance the vertical stability of the container, a stabilizing ring is attached to the base structure and forms an annular lower support having an enlarged diameter relative to the base structure.

The plastic container of this invention thus achieves the objectives of providing a economical and consistently blow molded container having a deformation resistant base structure and good vertical stability characteristics. Alternative embodiments of the stabilizing ring can be used to achieve the objectives of the invention. For example, the stabilizing ring 40 can be made with lightening holes to reduce the amount of material in the ring. The ring 50 can include vertical stiffening ribs in the supporting wall 54 if added strength is desired. Additionally, the supporting wall 54 can be curved radially outwardly to increase the shock absorbing capability of the ring.

It is to be understood that the invention is not limited to the exact construction illustrated and described above, but that various changes and modifications, such as those described above, may be made without departing from the spirit and scope of the invention as defined in the following claims.

What is claimed is:

1. A plastic container for carbonated beverages comprising:

a tubular body having an upright sidewall and a base structure extending downwardly from said sidewall so as to close the lower end of said tubular body, said base structure including an upwardly concave bottom wall at the center of said base structure, a heel portion at the periphery of the bottom wall forming the lowermost portion of said tubular body and having a diameter less than the diameter of the sidewall and an outer wall having a lower end merging with said heel portion and an upper end merging with said sidewall, said outer wall inclined radially inwardly and upwardly from said lower end to form a radially inwardly recessed portion in said outer wall, said outer wall extending upwardly and radially outwardly from said recessed portion to said outer wall upper end; and a stabilizing ring seated in said recessed portion and extending radially outwardly and downwardly from said outer wall, said stabilizing ring terminating at a lower end portion radially outwardly and axially downwardly of said heel portion to form a support surface for said container radially outwardly of said heel portion to stabilize said container against tipping, said outer wall being flexible so that when the container is filled, the lower end of the outer wall below said recessed portion is forced to move outwardly and prevents removal of the ring.

2. The container of claim 1 wherein the heel portion, when the container is empty, is resilient to enable said ring to be snap-fit over said heel portion into engagement with said outer wall recessed portion.

3. The container of claim 1 wherein the diameter of the lower end portion of said stabilizing ring is approximately equal to the diameter of the tubular sidewall of the bottle.

4. The container of claim 1 wherein said stabilizing ring is generally wedge shape in radial cross section tapering radially outwardly and downwardly.

5. The container of claim 1 wherein the stabilizing ring is generally arch shape in radial cross section having a radially inner wall seated in said recessed portion and a radially outer wall forming the lower end portion.

6. The container of claim 1 wherein the stabilizing ring is adhesively bonded to the base structure.

7. A plastic container for carbonated beverages comprising:

a tubular body having an upright sidewall and a base structure extending downwardly from said sidewall so as to close the lower end of said tubular body;

said base structure having an annular outer wall with upper and lower ends with the upper end merging with the sidewall, and an inner wall disposed within said outer wall having an axially raised central dome portion extending upwardly into the container with a concave exterior surface, said inner wall having a radially outer periphery merging with the lower end of the outer wall forming a heel portion at the lowermost point of said base structure having a diameter less than the diameter of the sidewall, said outer wall inclined radially inwardly and upwardly from said outer wall lower end to form a radially inwardly annular recessed portion in said outer wall; and an annular stabilizing ring seated in said recessed portion, said stabilizing ring having a radially inner engaging portion for engagement with said outer wall and a support portion forming an annular support radially outwardly and axially downwardly from said engaging portion for supporting said container in an upright manner, said outer wall being flexible so that when the container is filled, the lower end of the outer wall below said recessed portion is forced to move outwardly and prevents removal of the ring.

8. The container of claim 7 wherein the heel portion, when the container is empty is resilient to enable said ring to be snap-fit over said heel portion into engagement with said outer wall recessed portion.

9. The container of claim 7 wherein the diameter of the annular support is approximately equal to the diameter of the tubular sidewall of the bottle.

10. The container of claim 7 wherein said stabilizing ring is generally wedge shape in radial cross section tapering radially outwardly and downwardly.

11. The container of claim 7 wherein said ring is generally arch shape in radial cross section with the bottle engaging portion of said stabilizing ring including a bottle engaging wall which engages said annular recessed portion and a portion of said outer wall above said recessed portion, and the support portion of said ring including a supporting wall extending radially outwardly and downwardly from said engaging wall, said supporting wall having a lower edge forming said annular support of the container.

12. The container of claim 7 wherein the stabilizing ring is adhesively bonded to the base structure.

13. The container of claim 11 wherein the stabilizing ring is adhesively bonded to the outer wall.

* * * * *